US005219161A

United States Patent [19]

Williams, Sr.

[11] Patent Number: 5,219,161

[45] Date of Patent: Jun. 15, 1993

[54] GOLF DRIVING RANGE

[76] Inventor: Bradley M. Williams, Sr., 4940 Bascule Ave., Woodland Hills, Calif. 91364

[21] Appl. No.: 728,292

[22] Filed: Jul. 11, 1991

[51] Int. Cl.[5] ..... A63B 69/36

[52] U.S. Cl. ..... 273/35 B; 273/176 H; 273/178 B; 273/184 R

[58] Field of Search ..... 273/178 B, 35 B, 182 R, 273/182 A, 176 H, 176 A, 176 B, 176 J, 176 K, 176 L, 181 G, 181 E, 181 R, 184 A, 184 R, 185 R

[56] References Cited

U.S. PATENT DOCUMENTS

| | | | |
|---|---|---|---|
| 1,662,864 | 3/1928 | Petersen | 273/176 H |
| 3,104,879 | 9/1963 | Jetton | 273/176 A |
| 3,508,756 | 4/1970 | Bedford | 273/176 H |
| 3,595,581 | 7/1971 | Anderson et al. | 273/176 H |
| 3,693,979 | 9/1972 | Koett | 273/176 H X |
| 3,966,212 | 6/1976 | Mason | 273/178 B X |
| 4,018,436 | 4/1977 | Leigh | 273/35 B |
| 4,120,496 | 10/1978 | Niina | 273/34 R |
| 4,202,547 | 5/1980 | Mueller | 273/178 B X |
| 4,270,751 | 6/1981 | Lowy | 273/34 R |
| 4,846,478 | 7/1989 | Saint-Cricq | 273/178 B X |
| 4,922,222 | 5/1990 | Baker | 273/34 R X |
| 5,005,837 | 4/1991 | Martinez | 273/176 H X |

*Primary Examiner*—George J. Marlo

*Attorney, Agent, or Firm*—Poms, Smith, Lande & Rose

[57] ABSTRACT

An apparatus adapted for use as a green on a golf driving range wherein golf balls which land on the apparatus are prevented from remaining thereon. The apparatus includes a golf green surface having a perimeter in the shape of a golf green and an interiorly located cup opening. The apparatus includes self-clearing means for preventing golf balls which land on the golf green surface from remaining thereon. The self-clearing of golf balls is accomplished by either shaping the green surface so that golf balls inherently roll off of the green or by providing a mechanism which raises and lowers one end of the green surface in order to clear balls therefrom. The self-clearing green is well-suited for use on golf driving ranges where the clutter of golf balls on target greens reduces the value of the green as a realistic target for golfers using the range.

8 Claims, 2 Drawing Sheets

GOLF DRIVING RANGE

BACKGROUND OF THE INVENTION

1. Field of the Invention:

The present invention relates generally to practice aids for use on golf driving ranges. More particularly, the present invention relates to a golf green which is specifically designed for use on a driving range to more accurately simulate actual conditions present on the golf course.

2. Description of Related Art:

Golf driving ranges are used frequently by both advanced golfers and beginning golfers for a myriad of purposes. The driving range is many times used by golfers to practice their swings when they do not have time for a complete round of golf or as a warm up session prior to play. Golf classes are also regularly held at driving ranges since a driving range is particularly well-suited for use by a relatively large number of individuals who are just beginning to develop and perfect a reasonably accurate golf stroke. The golf driving range is also used by experienced golfers who many times use the driving range for correctional practice sessions or advanced lessons.

In order to improve the usefulness of a golf driving range to both beginning and advanced golfers, it is desirable to provide a setting which simulates conditions present on an actual golf course. An example of a driving range which was designed to provide a realistic golf course simulation is described in U.S. Pat. No. 3,104,879 which was issued on Sep. 24, 1963 to J. Jetton. In this particular patent, a driving range is described in which various features usually found on a regulation golf course are provided on the driving range. For example, various greens and hazards are located on the driving range. The greens are located at different positions on the driving range to give both the experienced and beginning golfer an opportunity to aim for specific targets with the exciting possibility of sinking a hole-in-one. In order to increase interest in aiming for specific targets, the Jetton patent includes signalling devices associated with the hole on each green to indicate when a hole-in-one is scored.

The placement of golf greens on a driving range not only increases interest and competition between golfers on the range, but also improves the quality of practice because it more closely simulates actual golf course conditions and provides realistic targets for the golfer. One problem with providing golf greens on a driving range is that the majority of golfers tend to aim for the individual greens. As a result, the greens quickly become cluttered with golf balls. This is an unsatisfactory situation for a number of reasons.

First, greens on actual golf courses are seldom cluttered with more than three or four balls at one time. Accordingly, in order to accurately simulate actual golf course conditions, it is desirable that the golf green target be relatively free of golf balls. Second, the presence of numerous golf balls on the golf green increases the likelihood that an incoming ball will strike one or more balls which are already on the green. The resulting deflection of the incoming ball is highly distracting and disruptive.

In view of the above, it would be desirable to provide a golf green which is adapted for use on a golf driving range wherein golf balls which land on the green are prevented from remaining thereon for any appreciable length of time. Such a self-clearing golf green would have few if any golf balls on the green at any one time. The green could then be used as a target by numerous golfers on the driving range without the above-discussed problems experienced with conventional greens which are continually cluttered with golf balls.

It would also be desirable to provide such a self-clearing golf green which includes various indicating devices to signal to the golfers when a hole-in-one has been scored. In addition, it would be desirable to provide a signalling device which would signal to the golfers when their shots strike or land on the green. In this way, recognition and feedback to the golfers would occur for shots which land on the golf green, but do not fall into the cup.

SUMMARY OF THE INVENTION

In accordance with the present invention, an apparatus is provided which is adapted for use as a green on a golf driving range wherein golf balls which land on the apparatus are prevented from remaining thereon for any appreciable length of time. The apparatus includes a golf green surface having a perimeter in the shape of a golf green and an interiorly located cup surface defining a cup opening in the golf green through which golf balls may pass. As a feature of the present invention, the apparatus includes self-clearing means for preventing golf balls which land on the golf green surface from remaining thereon.

As one feature of the present invention, the self-clearing means involve sloping the golf green surface so that golf balls which land on the golf green surface will eventually roll off of the surface onto the adjacent driving range surface. The golf green surface may be relatively planer or undulating provided that the slope design of the surface is such that no matter where the golf ball lands on the surface, it will eventually roll off onto the adjacent driving range surface if it does not first fall into the cup.

As another feature of the present invention, lift means are provided for differentially elevating the front and rear portions of the golf green surface to cause the golf balls to roll off. Additional features of the present invention include providing means for indicating when a golf ball passes through the cup opening and/or means for indicating when a golf ball strikes or lands on the golf green surface.

As a further feature of the present invention, a cup associated with the cup surface is provided for receiving golf balls which may fall through the cup opening. Golf ball removal means are further provided for removing the golf balls from the cup and transporting them to the driving range surface at a location outside of the perimeter of the golf green. The golf green surface may be located at the same elevation as the surrounding driving range surface or, alternatively, mounting means are provided for mounting the golf green surface at an elevation above the surrounding driving range surface. As a feature of the present invention, when the golf green surface is elevated above the driving range elevation, a transition surface is provided which extends between the driving range surface and the golf green surface perimeter to allow golf balls which fall short of the green the opportunity to roll up onto the green and possibly score a hole-in-one.

As another feature of the present invention, a hole indicating flag is provided wherein a flag is attached to the upper end of a pole and the lower end of the pole is mounted to the cup to provide an indication of the location of the cup opening. The pole lower end and the cup opening are designed so as not to prevent golf balls falling into the cup opening and scoring a hole-in-one.

The above features and many other attendant advantages of the present invention will become better understood by reference to the following detailed description when taken in conjunction with the accompanying drawings.

DETAILED DESCRIPTION OF THE PREFERRED EMBODIMENTS

Figure 1:
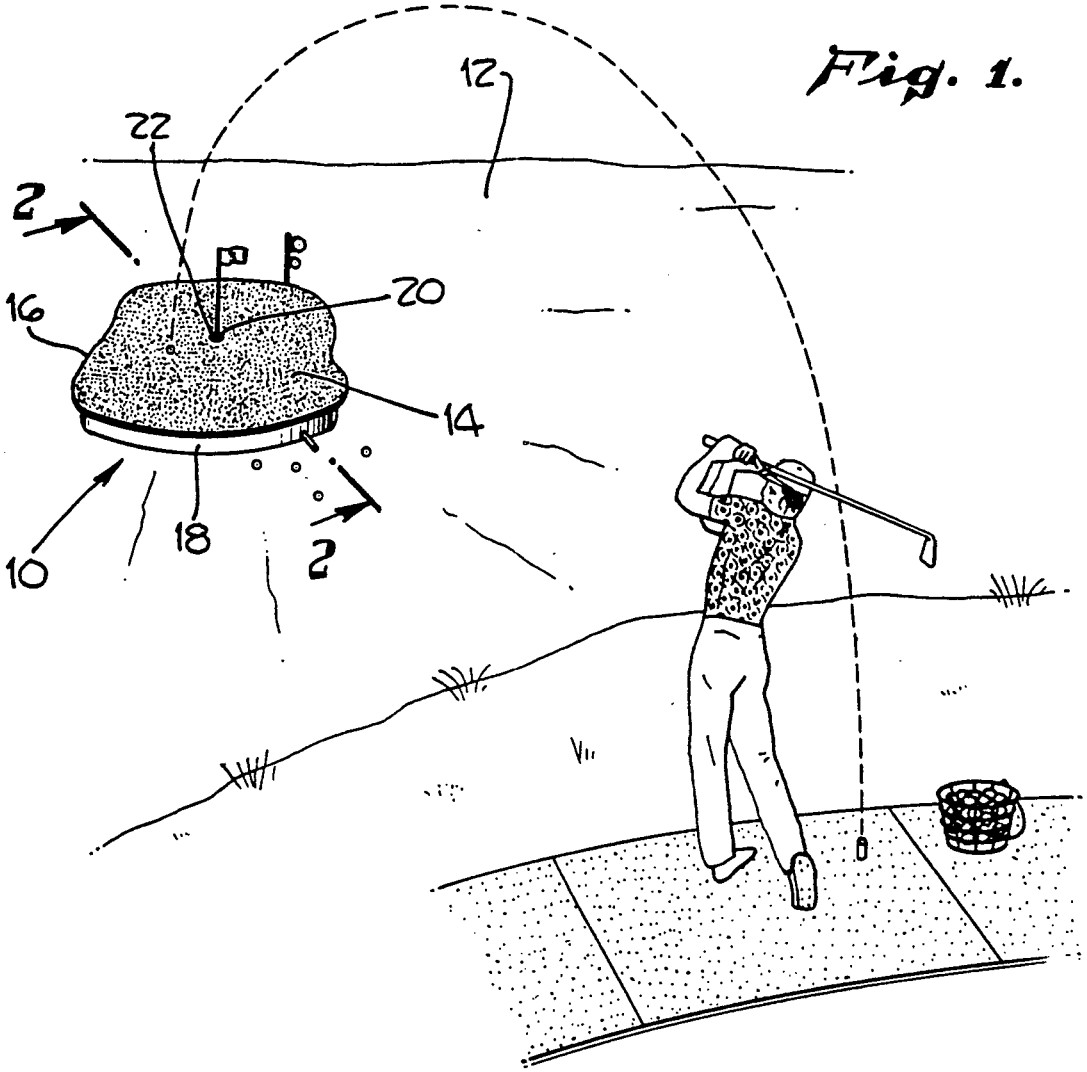
FIG. 1 is a perspective view showing a preferred exemplary self-clearing golf green in accordance with the present invention in place on a driving range.

A preferred exemplary golf green in accordance with the present invention is shown generally at 10 in FIG. 1. The golf green 10 is shown in position on a driving range 12. The golf green 10 includes a golf green surface 14 which has a perimeter 16. The golf green surface 14 is shown mounted upon a foundation 18, the mounting means or foundation 18 preferably locates the green surface 14 at an elevation that is between 12 to 24 inches above the driving range surface 12 which is located adjacent to the green surface 14. Alternatively, the green surface 14 may be mounted at the same elevation as the driving range surface 12. However, it is preferred to elevate the green surface 14 above the driving range surface 12 as shown in FIGS. 1 and 2.

The golf green surface 14 includes an interiorly located cup surface 20 which defines a cup opening 22 through which golf balls may pass to score a hole-in-one. The cup opening 22 is preferably the same size as the holes in regulation golf greens.

Figures 2, 3:
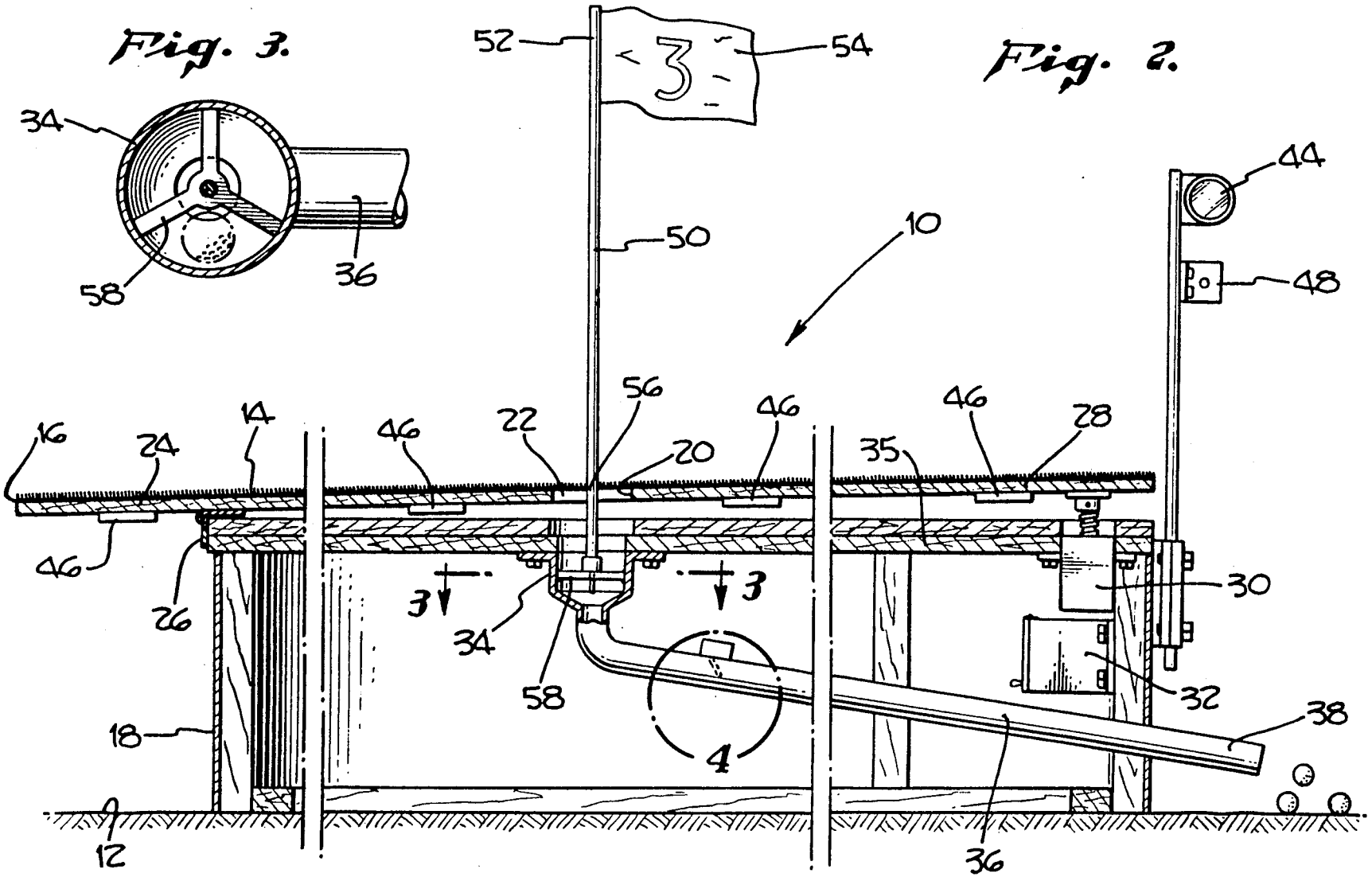
FIG. 2 is a sectional view of FIG. 1 taken in the 2—2 plane.
FIG. 3 is a sectional view of FIG. 2 taken in the 3—3 plane.

Referring to FIG. 2, in a preferred exemplary embodiment, the golf green surface 14 is pivotally mounted onto foundation 18. The front portion 24 of the green surface 14 is mounted to foundation 18 by way of hinge 26. The rear portion 28 of the green surface 14 is connected to a screw-type lifting mechanism 30. The lift mechanism 30 is designed to raise and lower the rear portion 28 to provide a variable forward slope to the green surface 14.

A control cabinet 32 is provided for allowing selective raising and lowering of rear portion 28. Preferably, rear portion 28 is repeatedly cycled between a raised position and a lowered position by lift mechanism 30. In the raised position, the golf green surface 14 is sloped sufficiently forward so that golf balls will roll relatively quickly off of the green. This provides for continual self-clearing of the green when the lift mechanism 30 is activated to raise rear portion 28. The golf green surface 14 is shown in a partially raised position in FIG. 2.

Alternatively, self-clearing means may be provided by shaping the green surface 14 so that golf balls which land on the green and do not fall through the hole opening 22, will eventually roll towards the golf green perimeter and eventually off the green. Such contoured greens may be made into a wide variety of shapes provided that no matter where the golf ball lands on surface 14, it will eventually roll off onto the surrounding range surface 12. The contoured surface may be complex or simple.

The golf green surface 14 may be made from any suitable simulated grass surface. Preferably, the green surface will include artificial turf mounted on a structurally strong board. The golf green surface perimeter can be any shape desired. Preferably, the golf green perimeter 16 will be a free-form elliptical or circular shape which mimics the shape of greens commonly found on golf courses.

The foundation 18 can be made from any sturdy material commonly used in the construction industry. Wood, metal and concrete blocks are preferred construction materials. Earthen foundations are also possible. Preferably, the foundation and golf green surface are made from relatively lightweight materials to allow easy transportation of the golf green to different locations on the driving range, if and when desired.

Referring again to FIG. 2 a cup 34 is mounted beneath the cup opening 22. The cup 34 is preferably mounted to an upper member 35 of the foundation so that the cup 34 remains stationary during the continual cycling of the green surface 14 between raised and lowered positions.

Golf ball removal means for removing golf balls from the cup 34 is provided by conduit 36. The conduit 36 includes an exit 38 which is located outside of the apparatus 10. Location of exit 38 outside of the golf green apparatus 10 is preferred in order to make it easier for range ball recovery equipment to pick up the balls.

Although it is preferred that the golf green surface 14 be substantially planer in order to make fabrication easier, a wide variety of undulating surfaces are possible provided that the contour of the golf green surface does not include any valleys or ridges which might trap golf balls and prevent them from being removed from the green by the lift mechanism 30. Although the lift mechanism 30 is shown as a screw type device, other suitable lift mechanisms, such as hydraulically actuated lift mechanisms may also be used. The lift mechanism 30 must be capable of lifting the rear portion to a sufficient height so that a forward slope is imparted to the green surface 14 that is sufficient to cause the balls to roll off relatively quickly. Preferred forward slopes are between $\frac{3}{4}$ inch per horizontal foot and 2 inches per horizontal foot. It is preferred that the slope be sufficiently steep so that substantially all golf balls present on the green surface 14 will roll off of the surface within a few seconds.

Figure 4:
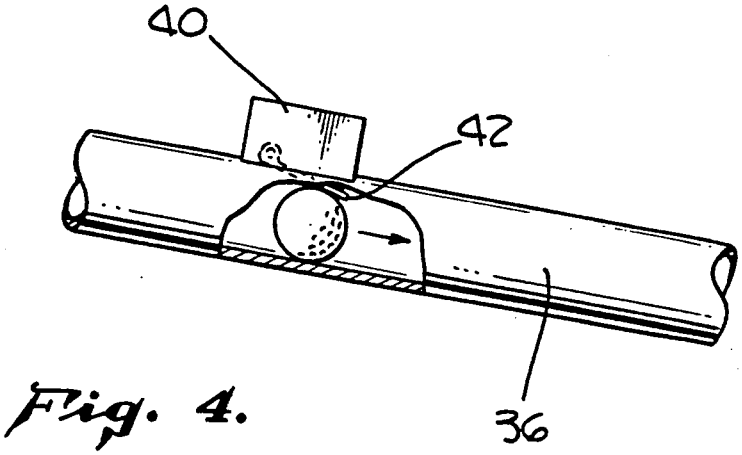
FIG. 4 is a detailed view of a preferred exemplary means for indicating when a golf ball passes through the cup opening.

The preferred exemplary apparatus 10 includes means for indicating when a golf ball passes through the cup opening 22. Referring to FIG. 4, a trip indicator 40 is provided which includes a gate arm 42 which is lifted every time a golf ball passes through conduit 36 from cup 22. The indicator 40 is connected to control box 32 which in turn operates signalling light 44 when the indicator 40 is actuated. A signalling horn may be used in place of light 44 or in conjunction therewith. In either case, the control box 32 activates the light or horn 44 when the indicator 40 is actuated. If desired, the control box 32 may also be connected to record keeping devices to keep track of the number of balls which fall into opening 22 and are registered as they bypass indicator 40.

Impact sensors 46 are preferably provided on the bottom of the golf green surface 14 in order to detect when a golf ball lands on the surface. The impact sensors 46 may be conventional devices which are connected to a second signal light or horn 48 by way of control box 32. The sensitivity of sensors 46 is adjusted so that light 48 is activated via control box 32 when a golf ball impacts green surface 14.

The golf green surface 14 shown in the preferred exemplary embodiment of FIG. 2 is located at an elevation above the surrounding driving range surface 12. Due to the elevated positioning of golf green surface 14, it is only possible for the golfer to hit balls onto the green by landing directly on the green or bouncing the golf ball onto the green. In order to accommodate shots which may be rolling on the ground, it is preferred that a transition surface be provided (not shown) which slopes down from the green surface perimeter to the driving range surface 12. The transition surface can be made from any suitable structurally strong material including wood, metal, fiberglass, etc. The transition surface need only extend around the front and sides of the green in order to allow approaching balls to roll up and onto the green surface. A transition surface at the back of the green is not necessary since balls should not be approaching the green from that direction.

A flag 50 is provided for indicating where the hole opening 22 is located. The flag 50 includes an upper end 52 to which is mounted an indicating flag 54. The lower end 56 of the flagpole is mounted within cup 34 by way of a mounting bracket 58. The mounting bracket 58 and pole 50 are designed to be of a sufficient size and configuration so that golf balls which enter opening 22 can pass through to conduit 36 without removal of either the flag 50 or mounting bracket 58.

Having thus described preferred exemplary embodiments of the present invention, it will be understood by those skilled in the art that the above disclosures are exemplary only and that the present invention is limited only by the following claims.

What is claimed is:

1. A golf driving range comprising:

a tee area where golfers drive golf balls toward a distant golf green surface;

an apparatus comprising a substantially planar, generally horizontal golf green surface having a perimeter in the shape of a golf green, a front portion, a rear portion and an interiorly located cup surface defining a cup opening in said surface through which golf balls may pass; and self-clearing means for preventing golf balls which land on said golf green surface from remaining thereon, said self-clearing means comprising means for changing the slope of said golf green surface relative to horizontal so that the rear portion of said golf green surface is vertically higher than the front portion, to provide for rolling of said golf balls off of said golf green surface.

2. A golf driving range according to claim 1 wherein said rear portion may be raised relative to said front portion to provide a slope of between about ¾ inch to about 2 inches per horizontal foot.

3. A golf driving range according to claim 1 wherein said apparatus further comprises:

a cup associated with said cup surface for receiving golf balls which may fall through said cup opening; and golf ball removal means for removing golf balls from said cup.

4. A golf driving range according to claim 3 wherein said golf ball removal means includes means for transporting said golf balls from said cup to a location outside the perimeter o said golf green surface.

5. A golf driving range according to claim 1 wherein said self-clearing means further comprises mounting means for mounting said golf green surface at an elevation above the elevation of said driving range surface adjacent to said golf green surface.

6. A golf driving range according to claim 5 which further comprises a transition surface which extends between said driving range surface and said golf green surface perimeter.

7. A golf driving range according to claim 1 wherein said apparatus further comprises means for indicating when a golf ball passes through said cup opening.

8. A golf driving range according to claim 1 wherein said apparatus further includes means for indicating when a golf ball lands on said golf green surface.

* * * * *